US010993529B2

(12) United States Patent
Xiang et al.

(10) Patent No.: US 10,993,529 B2
(45) Date of Patent: May 4, 2021

(54) EXERCISE BICYCLE WITH A DESK PLATE

(71) Applicant: Loctek Inc., Livermore, CA (US)

(72) Inventors: Lehong Xiang, Ningbo (CN); Tao Lin, Ningbo (CN); Dajiang Zhao, Ningbo (CN); Jie Zhao, Ningbo (CN)

( * ) Notice: Subject to any disclaimer, the term of this patent is extended or adjusted under 35 U.S.C. 154(b) by 0 days.

(21) Appl. No.: 15/870,953

(22) Filed: Jan. 14, 2018

(65) Prior Publication Data

US 2018/0338607 A1 Nov. 29, 2018

(30) Foreign Application Priority Data

May 25, 2017 (CN) ..... 201710379869.5

(51) Int. Cl.

| | |
|---|---|
| ***A47B 21/02*** | (2006.01) |
| ***A47B 13/00*** | (2006.01) |
| ***A47B 19/06*** | (2006.01) |
| ***A47B 13/08*** | (2006.01) |
| ***A63B 22/00*** | (2006.01) |

(Continued)

(52) U.S. Cl.

CPC ..... *A47B 21/02* (2013.01); *A47B 13/003* (2013.01); *A47B 13/081* (2013.01); *A47B 19/06* (2013.01); *A63B 22/0015* (2013.01); *A63B 22/0046* (2013.01); *A63B 22/0605* (2013.01); *A47B 9/00* (2013.01); *A63B 2210/50* (2013.01); *A63B 2225/093* (2013.01); *A63B 2225/68* (2013.01)

(58) Field of Classification Search

CPC ..... A63B 22/0605; A63B 22/0046; A63B 22/0015; A63B 2225/68; A63B 2225/093; A63B 2210/50; A47B 21/02; A47B 21/03; A47B 19/06; A47B 13/003; A47B 13/081; A47B 13/023; A47B 17/00; A47B 9/00; A47B 39/02; A47B 1/10; A47B 27/14; A47B 27/16; A47C 1/023; A47C 3/00; A47C 3/20; A47C 3/40; A47C 7/004

USPC ..... 108/4–6, 137, 138, 143; 297/215.13, 297/344.12

See application file for complete search history.

(56) References Cited

U.S. PATENT DOCUMENTS 5,620,067 A * 4/1997 Bauer ..... A47B 9/10 188/322.19
6,397,761 B1 * 6/2002 Moore ..... A47B 9/10 108/147

(Continued)

OTHER PUBLICATIONS (Sunny) Health & Fitness Magnetic Recumbent Desk Exercise Bike. Retrieved from Amazon. [Retrieved Jun. 10, 2019]. <URL: https://www.amazon.com/d/Exercise-Bikes/Sunny-Health-Fitness-Magnetic-Recumbent/B0716SJR9H> [Date Posted May 11, 2017] (Year: 2017).*

(Continued)

*Primary Examiner* — Garrett K Atkinson
*Assistant Examiner* — Zachary T Moore
(74) *Attorney, Agent, or Firm* — W&K IP

(57) ABSTRACT

A stationary exercise bike has an exercise bike body assembly and a desk plate assembly. The desk plate assembly includes a desk plate and a fixing seat for the desk plate. The desk plate is in slide connection with the fixing seat for the desk plate. The fixing seat for the desk plate is connected with the stationary exercise bike body assembly through a lifting assembly. The fixing seat for the desk plate can be lifted up and down relatively to the stationary exercise bike body assembly due to the connection of the lifting assembly.

3 Claims, 4 Drawing Sheets

(51) Int. Cl.
*A63B 22/06* (2006.01)
*A47B 9/00* (2006.01)

(56) References Cited

U.S. PATENT DOCUMENTS

| | | | | |
|---|---|---|---|---|
| 7,677,678 | B2 * | 3/2010 | Mosel | A61G 5/1094 312/231 |
| 8,763,981 | B2 * | 7/2014 | Friesen | A47C 3/30 248/565 |
| 9,655,438 | B1 * | 5/2017 | Shoenfeld | A47B 21/02 |
| 2005/0248194 | A1 * | 11/2005 | Hsien | A47C 1/023 297/344.11 |

OTHER PUBLICATIONS

Health & Fitness Magnetic Recumbent Desk Exercise Bike. <URL: https://www.amazon.com/d/Exercise-Bikes/Sunny-Health-Fitness-Magnetic-Recumbent/B0716SJR9H> [Date Posted May 11, 2017] (Year: 2017).*

* cited by examiner

EXERCISE BICYCLE WITH A DESK PLATE

CROSS-REFERENCE TO RELATED APPLICATIONS

This application claims priority to Chinese Patent Application No. 201710379869.5 with a filing date of May 25, 2017. The content of the aforementioned applications, including any intervening amendments thereto, are incorporated herein by reference.

TECHNICAL FIELD

The present disclosure relates to the field of fitness equip in particular to an exercise bicycle with a desk plate.

BACKGROUND OF THE PRESENT INVENTION

Exercise bicycles have gained great popularity, and for the purpose of working healthily, an exercise bicycle with a desk plate is introduced for office personnel to work out while handling office work. The desk plate can be used for placing laptops, mugs and other office related articles. People can exercise during work which fulfils their pursuit of health.

However, the existing desk plate on the exercise bicycle is not adjustable, which is not very user-friendly for people with different figures.

SUMMARY OF PRESENT INVENTION

The present disclosure discloses an exercise bicycle with a desk plate with a desk plate of which the position can be adjusted up and down or back and forth.

The present disclosure discloses an exercise bicycle with a desk plate, comprising an exercise bicycle body assembly and a desk plate assembly, wherein the desk plate assembly comprises a desk plate and a fixing seat for the desk plate, the desk plate is in slide connection with the fixing seat for the desk plate, the fixing seat for the desk plate is connected with the exercise bicycle body assembly through a lifting assembly, the fixing seat for the desk plate can be lifted up and down relatively to the exercise bicycle body assembly due to the connection of the lifting assembly.

In the present disclosure, the users can adjust the height of the desk plate as well as the distance to the desk plate, thus users with different heights and figures can all be accommodated. And it's convenient since all the adjustments can be done while the user sits on the exercise bicycle, and operate directly on the desk plate. Besides, the desk plate can be lifted and slid out of the exercise bicycle, and used as an independent standing table when the exercise bicycle is not in use.

The lifting assembly comprises a sliding sleeve, and a locking gas spring arranged inside the sliding sleeve; the lower end of the locking gas spring is connected with the exercise bicycle body assembly, and the upper end of the locking gas spring connected with the sliding sleeve: the sliding sleeve is inserted in the exercise bicycle body assembly, and the locking gas spring enables the sliding sleeve to move up and down relatively to the exercise bicycle body assembly; the fixing seat for the desk plate is provided with a first handle, the first handle is fixed with the control valve of the locking gas spring by a connection assembly to control the release and locking of the locking gas spring. The assisting force provided by the locking gas spring of the lifting assembly makes it easier for the user to lift the desk plate. And it's convenient to operate while the user can sit on the exercise bicycle instead of getting off.

The first handle is mounted on the fixing seat for the desk plate through a fixing seat for the first handle; the first handle is rotatably connected with the fixing seat for the first handle through a first rotating shaft; the other end of the first rotating shaft is connected with a pressing block, an ejector rod assembly with reset spring is arranged below the pressing block; the ejector rod assembly is connected with the upper end of the control valve of the locking gas spring; when the first handle is rotated, the pressing block is pressed to push the ejector rod assembly downwards, making the control valve of the locking gas spring in a released state: when the first handle is loosened, the ejector rod assembly is reset by the reset spring, making the control valve of the locking gas spring closed and the locking gas spring in a locked state. This mechanical structure has ensured the stableness and firmness of the connection of the handle and the fixing seat.

The lifting assembly adopts an electric linear driving device, using a first linear driving device to connect the fixing seat of the desk plate, and the exercise bicycle body, to control the lifting movement of the desk plate relative to, the exercise bicycle body: a control button of the first linear driving device is arranged on the desk plate. In this way, the lifting of the desk plate can be electrically controlled.

The sliding connection between the desk plate and the fixing seat for the desk plate is realized by a sliding rail mounted below the desk plate: a sliding block is provided on the fixing seat for the desk plate, and is in slide connection with the sliding rail; the desk plate is in slide connection with the fixing seat for the desk plate through the sliding rail; a locking device is arranged between the desk plate and the fixing seat for the desk plate to lock the desk plate in different sliding positions. In this manner, the desk plate can be locked in different positions according to the user's requirements.

The locking device comprises a second handle, and a limiting strip with teeth fixedly connected with the fixing seat for desk plate: the second handle is connected below the desk plate through the fixing seat for the second handle; the second handle is rotatably connected with the fixing seat for the second handle through a second rotating shaft, a toothed clamp is provided at the other end of the second rotating shaft, a reset torsion spring is arranged between the second rotating shaft and the fixing seat for the second rotating shaft; when the second handle is rotated, the toothed clamp is driven to rotate to disengage from the teeth on the limiting strip, so that the desk plate can slide relative to the fixing seat for the desk plate, when the second handle is released, the toothed clamp is reset by the reset torsion spring, and clamps in any tooth of the limiting strip to limit the position of the desk plate. The limitation is achieved by this locking device with simple structure, thus stable.

The locking device adopts a locking pin to lock, and further comprises a limiting strip with a plurality of limiting holes, a second handle fixed below the desk plate, a locking pin connected with the second handle; when the second handle is rotated, the locking pin is driven to separate from the limiting hole; when the second handle is released, the locking pin is reset by the reset device, and inserts in any limiting hole to limit the position of the desk plate.

A second electric linear driving device is provided between the desk plate and the fixing seat for the desk plate to control the movement of the desk plate relative to the fixing seat for the desk plate: a control button of the second linear driving device is arranged on the desk plate. The desk plate can be moved back and forth in an electric mode with great convenience and simplicity.

REFERENCE NUMBERS

1 exercise bicycle body assembly, 2 desk plate, 3 locking gas spring, 4 sliding sleeve, 5 first handle, 6 fixing seat for the first handle, 7 pressing block, 8 ejector rod assembly, 9 second handle, 10 fixing seat for the second handle, 11 fixing seat for the desk plate, 12 limiting strip, 13 sliding rail, 14 housing, 15 clamp, 16 reset torsion spring, 17 first rotating shaft, 18 second rotating shaft, 19 reset spring.

DETAILED DESCRIPTION OF PREFERRED EMBODIMENTS

The present disclosure would be described in greater detail hereinafter in combination with the accompanying drawings and embodiments.

As shown in FIG. 1, FIG. 2, FIG. 3, FIG. 4, the present disclosure discloses an exercise bicycle with a desk plate, comprising an exercise bicycle body assembly 1 and a desk plate assembly, wherein the desk plate assembly comprises a desk plate 2 and a fixing seat for the desk plate 11, the desk plate 2 is in slid connection with the fixing seat 11 for the desk plate, the fixing seat for the desk plate 11 is connected with the exercise bicycle body assembly 1 through a lifting assembly, the fixing seat of the desk plate 11 can be lifted up and down relatively to the exercise bicycle body assembly 1 due to the connection of the lifting assembly.

Figure 1:
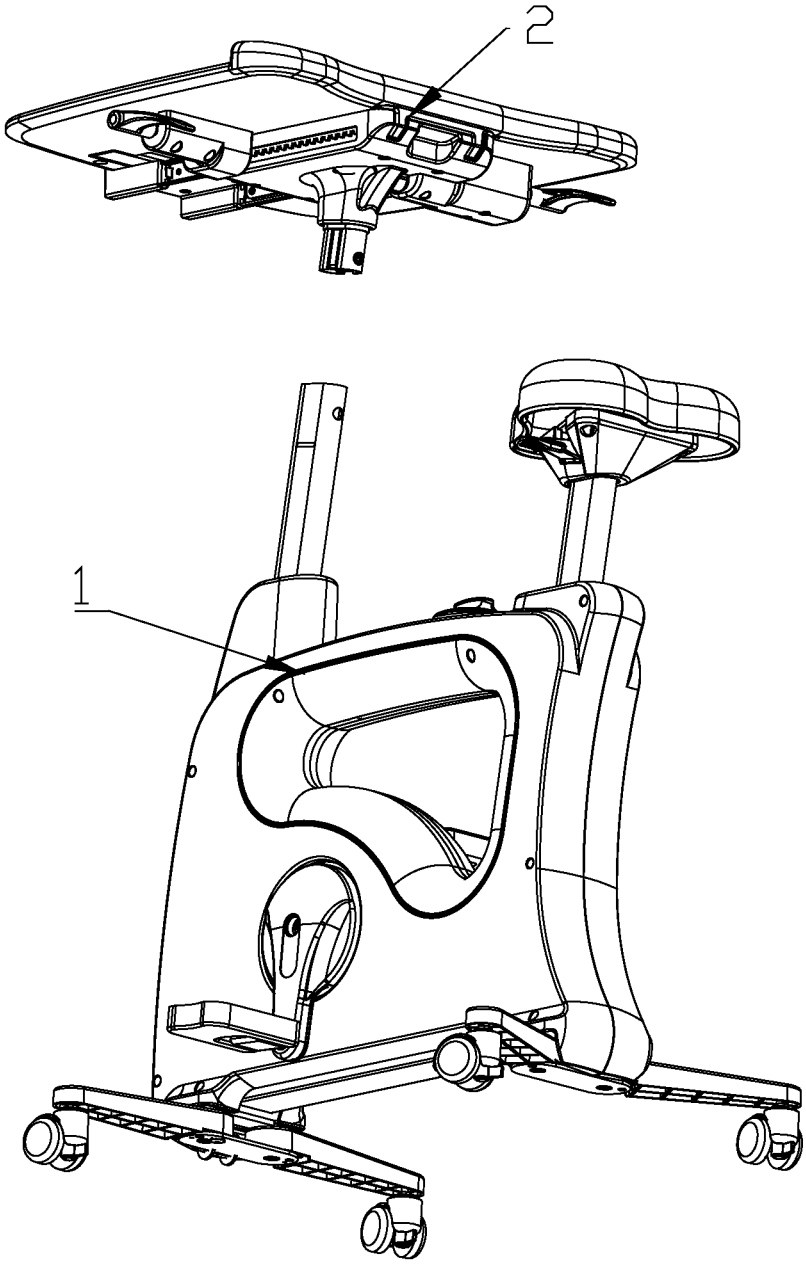
FIG. 1 is a structural schematic diagram of the exercise bicycle with a desk plate.
Figure 2:
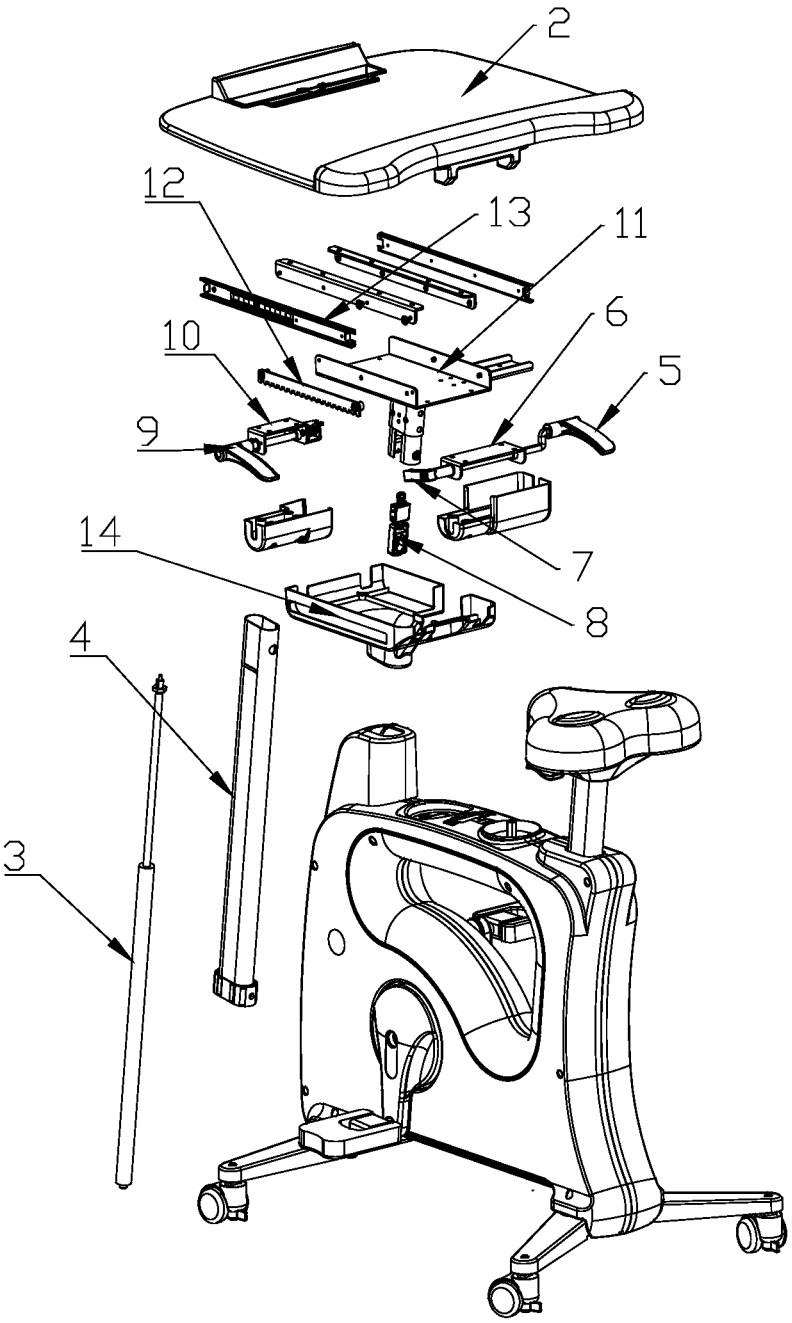
FIG. 2 is an explosive structural diagram of the exercise bicycle with a desk plate.
Figure 3:
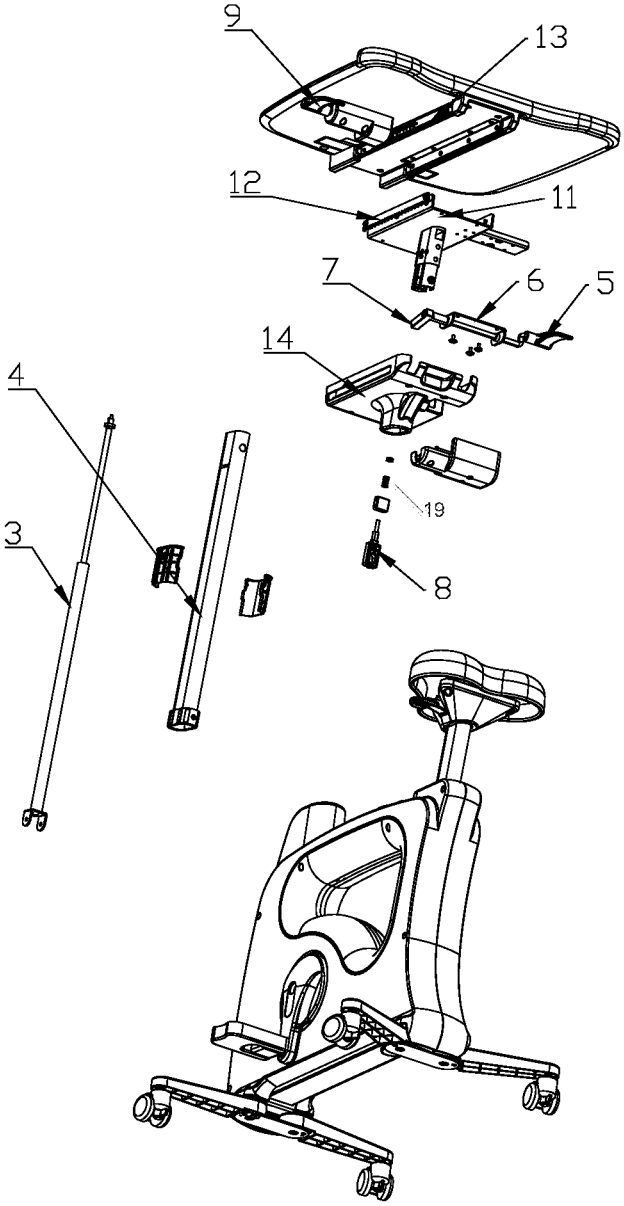
FIG. 3 is a partial explosive structural diagram of the exercise bicycle with a desk plate.

As shown in FIG. 2, and FIG. 3 the lifting assembly comprises a sliding sleeve 4, and a locking gas spring 3 arranged inside the sliding sleeve 4; the lower end of the locking gas spring 3 is connected with the exercise bicycle body assembly 1, usually attached to the frame which locates at the bottom of the exercise bicycle body assembly. And the upper end of the locking gas spring 3 connected with the sliding sleeve 4; the sliding sleeve 4 is inserted in the exercise bicycle body assembly 1. A vertical pipe is arranged in the exercise bicycle body assembly, and the sliding sleeve 4 is in slide connection inside the vertical pipe. The locking gas spring 3 enables the sliding sleeve 4 to move up and down relatively to the exercise bicycle body assembly 1; the fixing seat for the desk plate 11 is provided with a first handle 5, the first handle 5 is fixed with the control valve of the locking gas spring 3 by a connection assembly to control the release and locking of the locking gas spring 3.

The first handle 5 is mounted on the fixing seat for the desk plate 11 through a fixing seat for the first handle 6; in this embodiment, the fixing seat for the first handle 6 is of a U-shape structure, and is mounted under one side of the fixing seat for the desk plate 11. The first handle 5 is rotatably connected with the fixing seat for the first handle 6 through a first rotating shaft 17; the other end of the first rotating shaft 17 is connected with a pressing block 7, an ejector rod assembly 8 with reset spring 19 is arranged below the pressing block 7; the ejector rod assembly 8 is connected with the upper end of the control valve of the locking gas spring 3; when the first handle 5 is rotated, the pressing block 7 is pressed down to push the ejector rod assembly 8 downwards, the lower end of the ejector rod assembly 8 pushes the control value of the locking gas spring 3 downwards, making the control valve of the locking gas spring in the released state; when the first handle is loosened, the ejector rod assembly is reset by the reset spring 19, making the control valve of the locking gas spring closed and the locking gas spring in a locked state.

The lifting assembly mentioned above controls the lifting of the desk plate by the locking gas spring. Normal gas spring can also be used to control the lifting of the desk plate, but a height-locking mechanism will be required on the lifting assembly, which should also be within the protection scope of the present disclosure.

Preferably, the lifting assembly adopts an electric linear driving device, using a first linear driving device to connect the fixing seat of the desk plate and the exercise bicycle body, to control the lifting movement of the desk plate relative to the exercise bicycle body; a control button of the first linear driving device is arranged on the desk plate. The linear driving device is not described in detail herein since its prior art.

Figure 4:
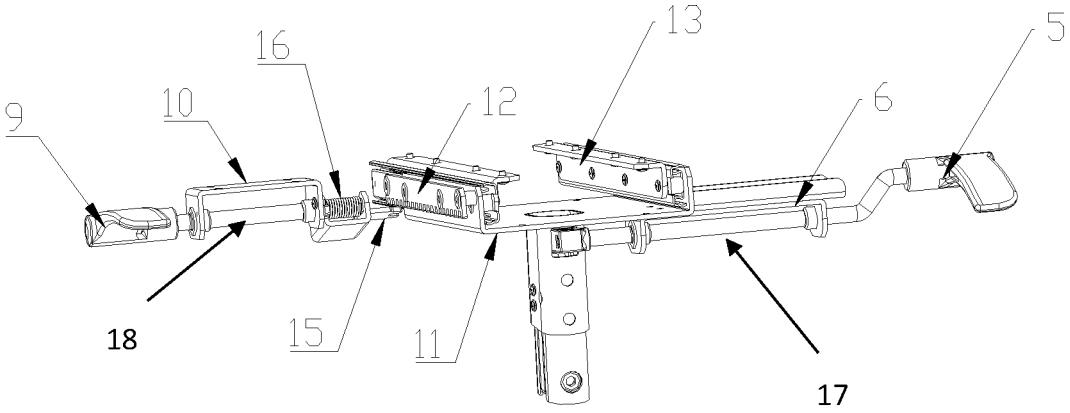
FIG. 4 is a structural schematic diagram of the locking device of the exercise bicycle with a desk plate.

As shown in FIG. 2 and FIG. 4, the sliding connection between the desk plate 2 and the fixing seat for the desk plate 11 is realized by a sliding rail 13 mounted below the desk plate 2; a sliding block is provided on the fixing seat for the desk plate 11, and is in slide connection with the sliding rail 13; the desk plate 2 is in slide connection with the fixing seat for the desk plate 11 through the sliding rail 13; a locking device is arranged between the desk plate 2 and the fixing seat for the desk plate 11 to lock the desk plate 2 in different sliding positions. The desk plate is usually in slide connection with the fixing seat for the desk plate with a sliding rail to ensure a smooth sliding of the desk plate relative to the fixing seat for the desk plate.

In the present embodiment, the locking device comprises a second handle 9, and a limiting strip 12 with teeth fixedly connected with the fixing seat for desk plate 11; the second handle 9 is connected below the desk plate 2 through the fixing seat for the second handle 10; the second handle is rotatably connected with the fixing seat for the second handle 10 through a second rotating shaft 18, a toothed clamp 15 is provided at the other end of the second rotating shaft 18, a reset torsion spring 16 is arranged between the second rotating shaft 18 and the fixing seat for the second rotating shaft 10; when the second handle 9 is rotated, the toothed clamp 15 is driven to rotate to disengage from the teeth on the limiting strip 12, so that the desk plate 2 can slide relative to the fixing seat for the desk plate 11, when the second handle 9 is released, the toothed clamp 15 is reset by the reset torsion spring 16, and clamps in any tooth of the limiting strip 12 to limit the position of the desk plate 2.

As another embodiment of the locking device, the locking device adopts a locking pin to lock, and further comprises a limiting strip with a plurality of limiting holes, a second handle fixed below the desk plate, a locking pin connected with the second handle: when the second handle is rotated, the locking pin is driven to separate from the limiting hole; when the second handle is released, the locking pin is reset by the reset device, and inserts in any limiting hole to limit the position of the desk plate.

The locking device can also be friction locking. Two friction sheet can be arranged respectively an the desk plate and the fixing seat for the desk plate. When the second handle makes the friction faces of the two friction sheets close to each other, the desk plate is locked by the friction force, and when the two friction sheets disengage, the desk plate can slide relative to the fixing seat of the desk plate.

Preferably, a second electric linear driving device is provided between the desk plate 2 and the fixing seat for the desk plate 11 to control the movement of the desk plate relative to the fixing seat for desk plate; a control button of the second linear, driving device is arranged on the desk plate. The desk plate can be moved back and forth in an electric mode with great convenience and simplicity.

We claim:

1. A stationary exercise bike with a desk plate, comprising a stationary exercise bike body assembly and a desk plate assembly, wherein the desk plate assembly comprises a desk plate and a fixing seat for the desk plate, the desk plate is in slide connection with the fixing seat for the desk plate, the fixing seat for the desk plate is connected with the stationary exercise bike body assembly through a lifting assembly, the fixing seat for the desk plate can be lifted up and down relatively to the stationary exercise bike body assembly due to the connection of the lifting assembly, the lifting assembly comprises a sliding sleeve, the sliding sleeve is inserted in the stationary exercise bike body assembly, the sliding sleeve can move up and down relatively to the stationary exercise bike body assembly, the sliding sleeve comprises an upper end and a lower end, the upper end of the sliding sleeve is connected to the fixing seat for the desk plate, and the lower end of the sliding sleeve is connected to the stationary exercise bike body assembly;

wherein the fixing seat for the desk plate further comprises a first handle and a fixing seat for the first handle;

wherein the lifting assembly further comprises a locking gas spring arranged inside the sliding sleeve, one end of the locking gas spring is connected with the stationary exercise bike body assembly, and the other end of the locking gas spring connected with the sliding sleeve; and wherein the first handle is rotatably connected with the fixing seat for the first handle through a first rotating shaft, the other end of the first rotating shaft is connected with a pressing block, an ejector rod assembly with a reset spring is arranged below the pressing block, the ejector rod assembly is connected with the other end of the locking gas spring, and when the first handle is rotated, the pressing block is pressed down to push the ejector rod assembly downwards, and the ejector rod assembly in turn pushes the locking gas spring downwards.

2. The stationary exercise bike with a desk plate of claim 1, wherein the sliding connection between the desk plate and the fixing seat for the desk plate is realized by a sliding rail mounted below the desk plate; the desk plate is in slide connection with the fixing seat for the desk plate through the sliding rail; a locking device is arranged between the desk plate and the fixing seat for the desk plate to lock the desk plate in different sliding positions.

3. The stationary exercise bike with a desk plate of claim 1, wherein the locking device comprises a second handle, and a limiting strip with teeth fixedly connected with the fixing seat for desk plate; the second handle is connected below the desk plate through a fixing seat for the second handle; the second handle is rotatably connected with the fixing seat for the second handle through a second rotating shaft, a toothed clamp is provided at the other end of the second rotating shaft, a reset torsion spring is arranged between the second rotating shaft and the fixing seat for the second rotating shaft; when the second handle is rotated, the toothed clamp is driven to rotate to disengage from the teeth on the limiting strip, so that the desk plate can slide relative to the fixing seat for the desk plate, when the second handle is released, the toothed clamp is reset by the reset torsion spring, and clamps in any tooth of the limiting strip to limit the position of the desk plate.

* * * * *